US006119952A

United States Patent [19]

Kappel et al.

[11] Patent Number: 6,119,952

[45] Date of Patent: Sep. 19, 2000

[54] DEVICE AND METHOD FOR DOSING FLUID

[75] Inventors: Andreas Kappel, Brunnthal; Randolf Mock, Munich; Hans Meixner, Haar, all of Germany

[73] Assignee: Siemens Aktiengesellschaft, Munich, Germany

[21] Appl. No.: 09/384,357

[22] Filed: Aug. 27, 1999

[30] Foreign Application Priority Data

Aug. 27, 1998 [DE] Germany ..... 198 39 125

[51] Int. Cl.[7] ..... F02D 1/06; F02M 47/02; F02M 61/00; B05B 9/00

[52] U.S. Cl. ..... 239/5; 239/88; 239/124; 239/533.12

[58] Field of Search ..... 239/5, 88, 89, 239/91, 533.3, 533.12, 124; 251/129.05, 129.06; 92/174

[56] References Cited

U.S. PATENT DOCUMENTS

| | | | |
|---|---|---|---|
| 2,521,224 | 9/1950 | Kammer | 239/88 |
| 3,076,439 | 2/1963 | Arnold | 92/174 |
| 4,909,440 | 3/1990 | Mitsuyasu et al. | 239/96 |

FOREIGN PATENT DOCUMENTS

| | | |
|---|---|---|
| 0 477 400 A1 | 4/1992 | European Pat. Off. . |
| 43 06 073 C1 | 6/1994 | Germany . |
| 43 06 072 C2 | 12/1994 | Germany . |
| 44 06 522 C1 | 7/1995 | Germany . |
| 195 19 191 A1 | 12/1996 | Germany . |
| 197 32 802 A1 | 2/1999 | Germany . |

*Primary Examiner*—Andres Kashnikow
*Assistant Examiner*—Davis Hwu
*Attorney, Agent, or Firm*—Hill & Simpson

[57] ABSTRACT

A device and method for dosing fluid has a housing enclosing a lifting element and a primary drive hydraulically operable on the lifting element via a hydraulic chamber. The lifting element is disposed within a borehole with a leakage permitting fit. A fluid chamber in communication with the borehole contains a fluid to be dispensed in a dosed manner by controlled axial movement of the primary drive and lifting element.

31 Claims, 1 Drawing Sheet

DEVICE AND METHOD FOR DOSING FLUID

BACKGROUND OF THE INVENTION

1. Field of the Invention

The invention relates to a device and a method for the dosed delivery of fluid.

2. Description of the Prior Art

The significance of the demand for a precise dosing of a fluid is increasing, for instance in gasoline direct injection in the context of designing a lean-mix engine. With a lean-mix engine design, a reduction of the $CO_2$ exhaust is intended.

For purposes of realizing a lean-mix engine, a high requirement is established for dosing of the fuel, namely a simultaneous axially symmetric fuel distribution, use of the engine given high temperature gradients of approximately 150°, a high injection pressure up to 250 bars, a short drive-dead-time of less than 0.1 ms, and a short switching time of less than 0.15 ms, among other things.

This requirement can be only insufficiently met using an electromagnetically driven dosing mechanism due to the limited switching time. A piezoelectric actuator, on the other hand, is characterized by a very short response time and dead time. However, given the use of a piezoelectric direct drive, the insufficient compensation of length modifications of the piezoactuator and housing which are conditioned by temperature effects or by aging and settling effects is disadvantageous. Also, a piezoactuator of great structural length is required for this, which is disadvantageous to production and is expensive.

In addition, a piezoelectric actuator combined with a membrane hydraulic results in problems such as, a mechanical calibration involving great outlay, a danger of breaking the membrane, and a low degree of effectiveness.

German Offenlegungsschrift 43 06 073 teaches a measuring device for fluids wherein a piezoelectric actuator via a fluid-filled chamber, drives a lifting element that controls a fluid delivery. This device has the disadvantage of a high outlay and a vulnerable design in the drive field, as well as a separation of the hydraulic circuits at the drive side and at the injection side.

German Offenlegungsschrift 195 19 191 discloses an injection valve wherein the movement of a piezoactuator directly controls a tappet by means of a piston-hydraulic stroke translation. This valve is reliant on the use of control surfaces at the valve tappet. Furthermore, a motion-commutating stroke translation is disclosed which presupposes a development for the hydraulic chamber that is expensive. The fluid is also delivered via at least one injection opening, whereby the danger of an occlusion exists, and whereby an axially symmetric fuel delivery is also strongly prevented.

SUMMARY OF THE INVENTION

An object of the present invention is to provide a simplified, reliable and precise method and device for the dosed delivery of fluids.

The present invention provides a lifting element at the secondary side hydraulically connected to a primary drive by a hydraulic chamber. The primary drive hydraulically moves the lifting element, whereby the lifting element opens to the outside and directly controls a dosed fluid delivery.

To this end, the lifting element is driven into a borehole at the secondary side, which opens into the outside space at one side, such that the element can be displaced axially and is affected by leaks. The borehole at the secondary side is subjected to pressure of the fluid via a feed line. The borehole at the secondary side and the hydraulic chamber are fluidly connected to each other by the fit between the lifting element and a housing which is affected by leaks.

For purposes of dosing the fluid, a sealing element of the lifting element opens to the outside so that the lifting element opens, or respectively, closes off the pressurized borehole in relation to the outside environment at the secondary side.

Elements which are connected hydraulically from the primary drive up to and excluding the hydraulic chamber, such as a piezoactuator are located on the primary side. On the other hand, elements which are connected hydraulically downstream of the primary drive and the hydraulic chamber, such as the lifting element are located on the secondary side.

The present invention further provides that the primary drive is maximally withdrawn from the hydraulic chamber in the neutral position. In an embodiment, a discharged piezoactuator is used to move the primary drive. The pressure of the fluid in the hydraulic chamber corresponds to the pressure in the feed line, due to the leak-affected, that is hydraulically throttled in the connection between the feed line and the hydraulic chamber. The lifting element at the secondary side is shifted maximally toward the hydraulic chamber. In an embodiment, this shifting is conducted by a readjusting device at the secondary side. The lifting element employs a sealing element to close the borehole at the secondary side against the outside environment.

During the stroke process, the primary drive is shifted to the hydraulic chamber. This increases the pressure in the hydraulic chamber, so that the lifting element at the secondary side is pushed away from the hydraulic chamber more strongly. Because the fluid only reaches the hydraulic chamber in a throttled manner, the pressure buildup is not prevented by the fluid that is relatively weakly affected by leaks.

Beginning at a specific pressure in the hydraulic chamber, the forces exerted on the lifting element in the direction of the hydraulic chamber, such as the forces exerted by readjusting device, are overcome, and the lifting element moves away from the hydraulic chamber. By this motion, the sealing element attached to the lifting element moves away from the mouth of the borehole at the secondary side and to the outside. Fluid is delivered into the outside environment through the open mouth in a dosed manner.

For purposes of returning to the neutral position, the primary drive is again contracted. The pressure of the fluid in the hydraulic chamber drops to such an extent that the lifting element is again shifted in the direction of the hydraulic chamber. In an embodiment, the pressure drop results from the force exerted by the readjusting device at the secondary side. When the lifting element has been pushed back in the direction of the hydraulic chamber to such an extent that it closes the borehole at the secondary side against the outside again, fluid losses in the hydraulic chamber due to leakage flows are compensated by the fit between the lifting element and housing.

The present invention provides the following advantages with the use of the hydraulic chamber:

(1) A potentially excessively low stroke of the primary drive can be enhanced by a stroke translation onto the lifting element at the secondary side (e.g.: stroke of the piezoactuator 40 $\mu$m, stroke of the lifting element 240 $\mu$m, a corresponding stroke translation of 6:1). The advantages of the primary drive, such as a very rapid and linear response behavior, are thus combined with the advantage of a sufficient stroke. It is thus possible to avoid one disadvantage of a piezoelectric direct drive, namely the requirement of an excessive piezo length.

(2) Changes in length of the piezoactuator and of the housing together with what is built into it effected by changes, such as thermal effects, aging, or settling effects, are largely compensated in that the hydraulic chamber is pressurized with fluid via a leakage flow. Thus, the pressure in the hydraulic chamber is independent of its volume over the long term. This results in a high precision over a large temperature range. It is also possible to balance these effects using a hydraulic chamber with a stroke translation of 1:1 or with a stroke reduction.

(3) The relative orientation of the borehole at the secondary side has no influence on the control behavior. Because of this, there can be several different oriented subelements at the secondary side, such as lifting elements in their respective boreholes.

(4) In contrast to a mechanical translator system, the disadvantageous effect of bending of components, friction, or respectively, the wearing or tilting of mechanical components is avoided.

(5) The shifting of the primary drive is forwarded with immediacy and precision. The advantage of using a primary drive which can be controlled rather effectively and which has a short dead time, such as a piezoactuator or a magnetostatic actuator, is maintained.

(6) Compared to a dosing device with return of motion, there is the advantage of a simple layout in the region of the hydraulic chamber. This layout is insensitive to tolerance in production. In addition, due to the outwardly opening tappet, an axially symmetric fuel delivery at the mouth is achieved. Moreover, due to the filling of the hydraulic chamber so as to be affected by leaks, a complicated filling arrangement or a separate hydraulic circuit for the hydraulic chamber are forgone.

The present invention is not advantageously limited to fuel injection, such as gasoline injection, a diesel injection or a methane injection for a gas motor. Rather, other uses are imaginable, such as a control of a hydraulic valve. Such a hydraulic valve can be utilized for controlling a brake circuit or for dosing an active vibration damper.

In addition, the present invention is not limited by the type of fluid. The fluid can be a liquid, such as water, or a gas, such as compressed air. Given a utilization of the dosing device for fuel injection, the fluid is advantageously a liquid such as gasoline, diesel, kerosine, petroleum or alcohol, or a gas, such as methane or butane.

DESCRIPTION OF THE PREFERRED EMBODIMENTS

Figure 1:
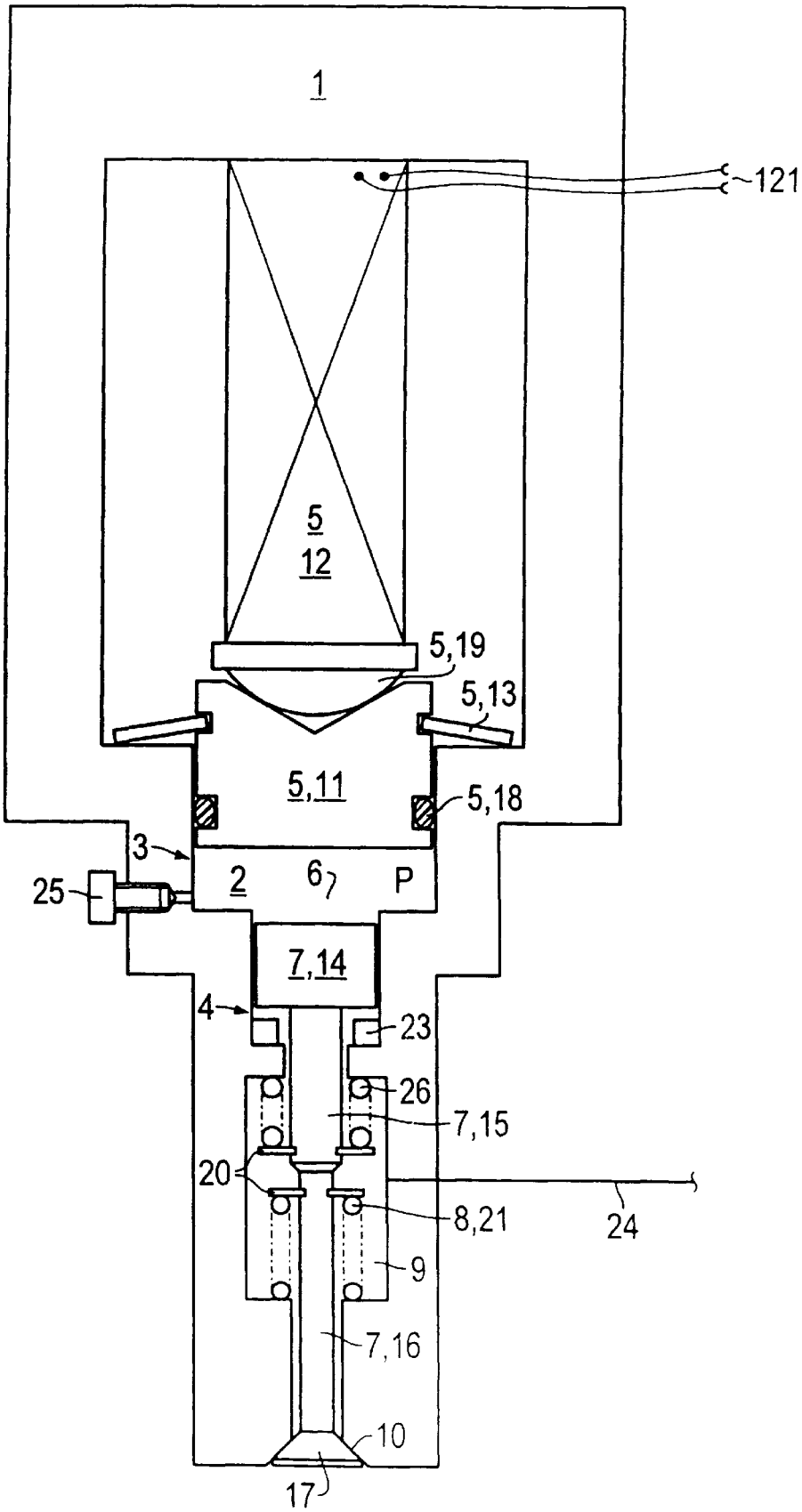
FIG. 1 is a side sectional view of a device for dosed delivery of fluid constructed and operating in accordance with the principles of the present invention.

A borehole 3 at a primary side and a parallel borehole 4 at a secondary side are installed in a housing 1, such that the two boreholes 3, 4 converge in a centered manner. They can also be perceived as one borehole with a varying diameter. This type of arrangement of two boreholes 3 and 4 opening into each other with a longitudinal axis along the same line carries the advantage of a simple and compact construction and correspondingly a simple production. The orientation of the two boreholes 3,4 relative to one another can also be realized differently, for instance offset or tilted relative to one another.

A pressure piston 11 is arranged in the borehole 3 at the primary side such that it can be displaced axially and at least partially lowered, as part of a primary drive, that is as part of a drive that can be controlled from the outside. A hydraulic chamber 2 is created by this arrangement inside the borehole 3 at the primary side. The hydraulic chamber 2 is pressurized with a fluid 6. It can also be constructed separately with a hydraulic connection to the boreholes 3,4.

The pressure piston 11 is pushed away from the hydraulic chamber by a readjusting device 13 at the primary side, as another part of the primary drive 5. The readjusting device 13 at the primary side can be a Bourdon spring (hollow cylinder with horizontal slots), for example, or it can advantageously include several cup springs arranged in parallel or in series. An actuator can also be used to automatically control the primary side readjusting device 13.

The fit between the pressure piston 11 and housing 1 is advantageously hydraulically tight. For purposes of a simpler design, it is advantageously sealed by means of a surrounding O-ring 18, which is inserted into a groove of the pressure piston 11. The O-ring 18 includes an elastomer material. A bead or membrane made of metal or plastic, for example, can also be used to seal the fit for purposes of enhancing the operational reliability and safety.

The pressure piston 11 is moved from its side which is averted from the hydraulic chamber 2 by an actuator 12 which is attached to the housing 1. As another subelement of the primary drive 5, the actuator 12 is advantageously a piezoelement. It can also be a multi-layer piezoactuator. The piezoactuator has the advantage that it responds to control signals very rapidly, and that its length adjustment is nearly exactly linear relative to the level of the control signal, such as a voltage or current signal. The use of a piezo multilayer system is advantageous in terms of control, due to the low operating voltage. The use of a ceramic-like piezo element with a high Curie temperature enables an operation over a broad temperature range. Besides a piezoactuator, a magnetostatic or electrostatic actuating element 12 can be used.

Between the actuator 12 and pressure piston 11, a spherical disk 19 is inserted, which comprises a corresponding support at the pressure piston 11 and which advantageously balances the tilts of the actuator 12, the housing 1 or the pressure piston 11 in order to prevent a gap resilience when an end face of the piezo is not plane parallel. The spherical disk 19 with the corresponding support can also be attached at the housing side between the actuator 12 and housing 1. However, the spherical disk 19 is not needed if there exists a sufficiently close fit between the actuator 12 and pressure piston 11.

The elements 5,11,12,13,19 at the primary side are assembled so as to be mechanically pressure-biased in a defined manner. This is advantageous given the use of a ceramic-like actuator 12, such as a ceramic piezoactuator, which can be easily destroyed by tensile stresses. The pressure bias can be additionally set by spacer disks (not illustrated) attached to the housing 1.

Of course, the primary drive 5 can also exists as an individual element, such as a piston-shaped piezoactuator. However, here the advantages of an optimized design of subelements with a conflicting requirement for material properties are forgone.

At a borehole 4 of the secondary side, a secondary side lifting element 7 is arranged such that it can be axially displaced and is affected by leaks to open into the hydraulic chamber 2. The primary drive 5 is thus connected hydraulically to the lifting element 7 by the hydraulic chamber 2. It is also possible for a number of boreholes 4 to open into the hydraulic chamber 2. The hydraulic chamber 2 can also be pressurized with fluid 6 directly by an additional fluid line (not illustrated). For purposes of venting the hydraulic chamber, a venting screw 25 is present.

The lifting element 7 includes a plurality of subelements 14–17. A jacking piston 14 in close proximity to the hydraulic chamber 2 is directed into the secondary side borehole 4 wherein it can be displaced axially and is affected by leaks. A piston rod 15 is connected to the jacking piston 14, which are depicted as one component here. A tappet 16 contacts the piston rod 15, whereby the piston rod 15 and the tappet 16 are not connected to each other fixedly. A mouth 10 of the borehole 4 at the secondary side can be closed against the outside by connecting the tappet 16 to a sealing element 17.

For purposes of realizing the piston-hydraulic stroke translation, the pressure-active surface of the pressure piston 11 is larger than that of the jacking piston 14. The "pressure-active surface" refers to the projection, in the direction indicated, of the surface that stands in contact with the fluid 6 of the hydraulic chamber 2. For example, the pressure-active surfaces of the pressure piston 11 and of the jacking piston 14, respectively correspond to its faces thereof that face the hydraulic chamber 2.

To obtain a predetermined maximum stroke, a catch 23 is advantageously provided for purposes of limiting the stroke of the jacking piston 14. The jacking piston 14 can be completely lowered into the borehole 4 at the secondary side or can even project partially into the hydraulic chamber 2. A part of the borehole 4 at the secondary side is constructed in the shape of a fluid chamber 9. The fluid chamber 9 is pressurized with the fluid 6 by a feed line 24.

A secondary side readjusting device 8 is attached in the fluid chamber 9. This device 8 includes a spiral spring 21, which is fastened at the tappet 16 by a Seeger ring 20, a snap ring, or some other similar fastening mechanism, and which presses the lifting element 7, or respectively, the tappet 16 in the direction of the hydraulic chamber 2. For purposes of filling with fluid 6 and of leakage compensation, the fluid chamber 9 can be connected to the hydraulic chamber 2 by a throttled connecting line or by a connecting line which is provided with a non-return valve (not illustrated) that opens in the direction of the hydraulic chamber.

The tappet 16 has a significantly smaller diameter than the borehole 4 at the secondary side. While the relatively close fit between the jacking piston 14 and borehole 4 at the secondary side causes a relatively low leakage flow, the fluid 6 can get from the fluid chamber 9 to the mouth 10 of the borehole 4 at the secondary side without significant throttling.

The piston rod 15 and the tappet 16 are not connected to one another fixedly. Rather, the piston rod 15 is held seated against the tappet 16 by a piston rod spring 26. The piston rod spring 26 is fixed at the piston rod 15 by a device such as a Seeger ring 20, a snap ring, or other similar device. The fact that the piston rod 15 and the tappet 16 are not fixedly connected provides the advantage of a simple installation into the housing 1. An additional advantage is that the influence of pressure peaks in the fluid 6 on the jacking piston 14 is ameliorated. The springing forces at the lifting element 7 are tuned such that, in the neutral state, the sealing element 17, which is designed in the shape of a mushroom valve, closes the mouth 10 against the outside environment from the outside. If, however, a fixedly connected unit of piston rod 15 and tappet 16 is used, then the piston rod spring 26 can be forgone. In this case, a single member, for instance with different diameters of the borehole 4 at the secondary side, can be used instead of the piston rod 15 and the tappet 16.

The present invention further provides a method for the dosed delivery of fluid. In a neutral position, the actuator 12, which is constructed as a piezoactuator, is discharged, or respectively, shorted, so that it has its minimal length in the axial direction and is maximally remote from the borehole 4 at the secondary side. The hydraulic chamber 2 is filled with fluid 6 via the leakage-permitting fit of jacking piston 7 and housing 1. The pressure P in the hydraulic chamber 2 essentially corresponds to the static pressure pending at the feed line 24, typically 25 to 250 bars.

The pressure piston 11 is biased towards the actuator 12 or to the spherical disk 19 thereof, by the readjusting device 13 at the primary side acted on by the pressure P of the fluid 6 in the hydraulic chamber 2. At the same time, the piston rod spring 26 presses the jacking piston 14 away from the hydraulic chamber 2. On the other hand, the forces of the readjusting device 8 at the secondary side—the forces of a spring 21 here—act on the lifting element 7. The resulting forces at the lifting element 7 are so dimensioned that the sealing element 17 closes the borehole 4 at the secondary side against the outside.

At the beginning of a stroking cycle, the actuator 12 is extended in the axial direction, usually 10–60 $\mu$m, due to an electrical signal such as a voltage or current signal at terminals 121. Given such a slight shift of the actuator 12, the O-ring 18 does not slide to the wall of the housing 1, but rather is deformed in a purely elastic manner, achieving an advantageous seal.

The actuator 12, attached to the top of the housing 1, presses the pressure piston 11 into the hydraulic chamber 2 with great force via the spherical disk 19, so that the pressure P therein rises. Due to the increased pressure P in the hydraulic chamber 2, fluid 6 drains via the leakage-permitting fit of the jacking piston 14 in the housing 1. The leakage flow, however, is not large enough in relation to the rate of the pressure rise to influence the pressure rise significantly.

Due to the increased pressure P, the force increases and is exerted on the jacking piston 14 and is directed away from the hydraulic chamber 2. When this force component surpasses the force component acting in the opposite direction, the lifting element 7 moves away from the hydraulic chamber 2 and lifts the sealing element 17 from the mouth 10 outwardly. Via the borehole 4 at the secondary side, the fluid 6 flows from the fluid chamber 9, past the tappet 16, and to the mouth 10 and is delivered therefrom into the outside environment in a dosed manner.

The stroke of the jacking piston 14, typically 60 to 360 $\mu$m, is limited by a stop 23. The dosing device is thus designed so that, given the stopping of the jacking piston 14, there is still a sufficient reserve of pressure for the lifting element 7 to be open a sufficient amount of time, despite the leaks arising at the hydraulic chamber 2. On the other hand, the leakage is dimensioned to guarantee an automatic return of the lifting element 7 into the neutral position, given an interruption of the electrical terminals 121 in the charged state of the actuator 12.

To return to the neutral position, the stroking process is ended by a contraction of the actuator 12. This can be done by a discharging of the piezoactuator. The mechanically biased cup spring 13 effects readjusting of the pressure piston 11 and the spherical disk 19. Due to the leakage that arose during the actuation period, the pressure P in the hydraulic chamber 2 temporarily drops below the static pressure. This loss of fluid 6 is refilled by a leakage flow from the fluid chamber 9. Upon the relaxing of the pressure P to the static pressure, the lifting element 7 is reset by the spring 21, and the mouth 10 is closed to the outside. This application is particularly advantageous in gasoline direct injection for lean-mix engines. It makes possible the creation of an effectively dosable pilot injection, for example. However, the fluid 6 can be a different liquid besides gasoline, such as diesel, kerosine, oil, methanol, or petroleum, or even a gas, namely natural gas.

The dosing device can be employed resulting in the particular advantage of low pulse/pause ratios (e.g. maximum injection period 1 ms every 24 ms given 5000 rpm in a 4-stroke motor). Relatively long pauses (e.g. 20 ms) guarantee a compensation of the leakages that arise during the short actuation period of the actuator 12 (e.g. 1 ms).

The dosing device illustrated in FIG. 1 has an axially symmetrical structure. Of course, it is possible to deviate from this structure. For example, the dosing device can be constructed from spatially distributed pressure chambers that are connected to one another fluid lines. The individual parts can also be given play. This is done at the expense of functionality, however.

Although modifications and changes may be suggested by those skilled in the art, it is the intention of the inventors to embody within the patent warranted hereon all changes and modifications as reasonably and properly come within the scope of their contribution to the art.

What is claimed is:

1. A dosing device for fluid, comprising:

a housing having a primary side and secondary side, said housing having a hydraulic chamber therein communicating with a borehole in said secondary side of said housing, said borehole terminating in a mouth communicating with an exterior of said housing;

an axial moveable lifting element having a sealing element disposed at said mouth, said lifting element being disposed in said borehole in said secondary side with a leakage-permitting fit;

a fluid chamber in communication with said borehole containing a fluid to be dispensed in a dose through said mouth;

a primary drive hydraulically operable on said lifting element via said hydraulic chamber to move said lifting element in a first direction to open said mouth by moving said sealing element away therefrom to allow said fluid to exit from said fluid chamber through said mouth; and said leakage-permitting fit causing said sealing element to remain away from said mouth for a predetermined time to control said dose of fluid, and thereafter causing said lifting element to move in a second direction, opposite said first direction to close said mouth to terminate said dose.

2. A dosing device according to claim 1 wherein said primary drive is hydraulically operable on said lifting element in a stroke-translated manner.

3. A dosing device according to claim 1 wherein said housing further comprises a borehole at said primary side containing said primary drive, said borehole and said borehole at said secondary side each open into said hydraulic chamber.

4. A dosing device according claim 3 wherein said borehole at said secondary side and said borehole at said primary side are situated along an identical longitudinal axis.

5. A dosing device according to claim 3 wherein said primary drive comprises a pressure piston, an actuator and a readjusting device at said primary side, said actuator axially shifts said pressure piston into said borehole at said primary side in a sealed manner and said readjusting device moves said pressure piston away from said hydraulic chamber.

6. A dosing device according to claim 5 wherein said primary drive further comprises a spherical disk disposed between said actuator and said pressure piston in non-positive contact with said housing.

7. A dosing device according to claim 5 wherein said actuator comprises an actuator element selected from the group comprising a piezoelectric, electrostatic or magnetostatic actuator element, said actuator element is adjusted by a control signal.

8. A dosing device according to claim 5 wherein said readjusting device comprises a Bourdon spring.

9. A dosing device according to claim 5 wherein said readjusting device comprises a plurality of cup springs.

10. A dosing device according to claim 5 wherein a plurality of spring elements are attached inside said hydraulic chamber, said spring elements along with said readjusting device press said primary drive away from said hydraulic chamber.

11. A dosing device according to claim 5 wherein said primary drive is disposed in said borehole in said primary side with a sealed fit from at least one bead.

12. A dosing device according to claim 1 wherein said fluid chamber accepts said fluid from a pressurized feed line.

13. A dosing device according to claim 1 wherein a readjusting device in the secondary side acts to press said lifting element in said second direction.

14. A dosing device according to claim 1 wherein said lifting element further comprises a jacking piston having a pressure-active surface in close proximity to said hydraulic chamber, said pressure-active surface is smaller than a surface of said primary drive in communication with said hydraulic chamber;

a piston rod attached to said jacking piston and disposed between said jacking piston and said sealing element; and a tappet disposed between said piston rod and said sealing element, said tappet is fixedly connected to said sealing element.

15. A dosing device according to claim 13 wherein said readjusting device at said secondary side is disposed in said fluid chamber.

16. A dosing device according to claim 13 wherein said readjusting device at said secondary side comprises a plurality of spring elements.

17. A dosing device according to claim 14 wherein a pressure spring is disposed in said fluid chamber and presses said piston rod in said first direction.

18. A dosing device according to claim 14 wherein said borehole, said jacking piston, said piston rod, said tappet and said sealing element are disposed in a hydraulic chamber.

19. A dosing device according to claim 1 wherein said hydraulic chamber is pressurized by a throttled fluid line.

20. A dosing device according to claim 19 wherein a throttled fluid line, having a non-return valve that opens to said hydraulic chamber, is disposed between said hydraulic chamber and said fluid chamber.

21. A dosing device according to claim 1 wherein said fluid comprises gasoline for use in a lean-mix engine.

22. A method for dosing fluid comprising the steps of:

providing a housing having a primary side and a secondary side, said housing having a hydraulic chamber therein communicating with a borehole in said secondary side, said borehole terminating in a mouth communicating with an exterior of said housing, said housing enclosing a lifting element, a primary drive and a fluid chamber, said lifting element having a sealing element disposed at said mouth and being disposed in said borehole in said secondary side with a leakage-permitting fit, said primary drive hydraulically operable on said lifting element via said hydraulic chamber and said fluid chamber in communication with said borehole containing a fluid to be dispensed in a dose through said mouth;

axially shifting said lifting element in a first direction by moving said primary drive into said hydraulic chamber;

opening said mouth by moving said sealing element away therefrom to allow said dose of fluid to exit from said fluid chamber through said mouth;

controlling said dose by said leakage-permitting fit causing said sealing element to remain away from said mouth for a predetermined time; and axially shifting said lifting element in a second direction, opposite said first direction, to close said mouth to terminate said dose.

23. A method according to claim 22 wherein said primary drive moves said lifting element in a hydraulically stroke-translated manner.

24. A method according to claim 22 wherein at least a portion of said borehole broadens to encompass said fluid chamber.

25. A method according to claim 22 further comprising the steps of providing a borehole at said primary side, said borehole and said borehole at said secondary side separately open into said hydraulic chamber containing a volume of said fluid having a pressure, said primary drive is disposed in said borehole at said primary side;

axially displacing said primary drive to a neutral position, said neutral position comprises said primary drive being shifted away from said hydraulic chamber and said lifting element being shifted in said second direction to close said mouth;

axially displacing said primary drive during a stroking cycle by reducing said volume with said displacement of said primary drive to increase said pressure until said lifting element is shifted in said first direction in a stroke-translated maimer, said shifting of said lifting element causes said sealing element to move away from said mouth for delivering said dose of fluid through said mouth; and returning to said neutral position by causing said lifting element to move in said second direction until said neutral position is attained again.

26. A method according to claim 22 wherein a readjusting device at said secondary side presses said lifting element in said second direction.

27. A method according to claim 25 wherein said primary drive comprises a pressure piston, an actuator, and a readjusting device, each disposed in said primary side;

said readjusting device presses said pressure piston away from said hydraulic chamber;

said actuator having a length, said length is varied by applying an electrical signal to allow said pressure piston to axially shift in said borehole in a sealed manner, said length is minimal when said pressure piston is pressed maximally away from said hydraulic chamber to said neutral position, said length is increased when said pressure piston is shifted during said stroking cycle, said length is reduced when said pressure piston returns to said neutral position.

28. A method according to claim 25 wherein said hydraulic chamber has a pressure, said pressure comprises from about 25 to about 250 bars in said neutral position.

29. A method according to claim 23 wherein said primary drive has a stroke, said stroke comprises from about 10 to about 60 $\mu$m.

30. A method according to claim 23 wherein said lifting element has a stroke, said stroke comprises from about 60 to about 360 $\mu$m.

31. A method according to claim 22 wherein said primary drive comprises an actuator having an actuator element, said actuator element moves to allow said primary drive to shift axially, said actuator element is selected from the group comprising a piezoelectric, electrostatic and magnetostatic element.

* * * * *